US005729993A

United States Patent [19]

Boiarski et al.

[11] Patent Number: 5,729,993

[45] Date of Patent: Mar. 24, 1998

[54] PRECOOLED VAPOR-LIQUID REFRIGERATION CYCLE

[75] Inventors: Mikhail Boiarski; Oleg Podcherniaev, both of Moscow, Russian Federation

[73] Assignee: APD Cryogenics Inc., Allentown, Pa.

[21] Appl. No.: 633,150

[22] Filed: Apr. 16, 1996

[51] Int. Cl.[6] ..... F25B 7/00; F25B 1/00

[52] U.S. Cl. ..... 62/175; 62/79; 62/335

[58] Field of Search ..... 62/175, 79, 335

[56] References Cited

U.S. PATENT DOCUMENTS 2,717,765 9/1955 Lawler, Jr. ..... 62/335 X
3,852,974 12/1974 Brown ..... 62/79

FOREIGN PATENT DOCUMENTS 6050617 2/1994 Japan ..... 62/335

OTHER PUBLICATIONS

Thorton et al., Dedicated Mechanical Subcooling Design Strategies for Supermarket Applications, Apr. 1994, Int. J. Refrig. 1994, vol. 17, No. 8, pp. 508–515.

*Primary Examiner*—William E. Wayner
*Attorney, Agent, or Firm*—Helfgott & Karas, P.C.

[57] ABSTRACT

A precooled vapor-liquid refrigeration cycle includes a basic vapor-liquid cycle and an auxiliary regenerative vapor-liquid cycle having a heat exchange relationship between them. The basic cycle includes a compressor connected in series with a condenser, throttle device, and evaporator. The auxiliary cycle includes a compressor, condenser, throttle device, and a counterflow heat exchanger, successively connected. The cycles each have condensers that are cooled by ambient air; the basic cycle is able to operate independently of the auxiliary cycle. To maximize the coefficient of performance, the basic cycle operates with a small pressure differential between compressor discharge and return. In the heat exchanger, refrigerant flow from the basic cycle condenser is further cooled in a counterflow arrangement by the low temperature refrigerant from the auxiliary cycle until the refrigerant in the basic cycle has been precooled from near ambient temperature to near the intended refrigeration temperature. Efficiency of the basic cycle and the system COP are improved. The refrigerant leaving the condenser in the auxiliary cycle, after passing through the auxiliary throttle device, flows through the heat exchanger in the counterflow arrangement with the very same refrigerant stream. The basic vapor-liquid cycle may operate using a single refrigerant or an azeotropic mixture. The auxiliary regenerative vapor-liquid cycle operates with a zeotropic mixture refrigerant. The basic cycle may operate when the auxiliary cycle is deactivated.

30 Claims, 9 Drawing Sheets

PRECOOLED VAPOR-LIQUID CYCLE (PVLC) CHARACTERISTICS

——— NONREGULATED PVLC DESIGNED FOR A MINIMAL OPERATING AMBIENT TEMPERATURE;

------- MAXIMAL-POSSIBLE IMPROVEMENT.

RELATIVE DATA PVLC/VLC:

$\bar{Q}_r$ - REFRIGERATION CAPACITY, $\bar{Q}_v$ - VOLUME REFRIGERATION CAPACITY, $\overline{COP}$ - COEFFICIENT OF PERFORMANCE.

PRECOOLED VAPOR-LIQUID CYCLE (PVLC) CHARACTERISTICS

——— NONREGULATED PVLC DESIGNED FOR A MINIMAL OPERATING AMBIENT TEMPERATURE;

------- MAXIMAL-POSSIBLE IMPROVEMENT.

RELATIVE DATA PVLC/VLC:

$\overline{Q}r$ - REFRIGERATION CAPACITY, $\overline{Q}v$ - VOLUME REFRIGERATION CAPACITY, $\overline{COP}$ - COEFFICIENT OF PERFORMANCE.

TABLE I
COMPARISON OF THE CYCLES BASED ON R12

REFRIGERATION TEMPERATURE Tr = 258 K,
EVAPORATOR TEMPERATURE Tev = 253 K
AMBIENT TEMPERATURE Ta = 323 K

| # | CYCLE | REFRIGERATION cap. Qr, W | COP | PRESSURE RATIO |
|---|---|---|---|---|
| 1 | VAPOR-LIQUID VLC | 234 | 2.22 | 10.0 |
| 2 | REGENERATIVE RVLC | 248 | 2.34 | 10.0 |
| 3 | CASCADE CVLC | 307 | 2.33 | 3.5....4.6 |
| 4 | PRECOOLED PVLC | 396 | 2.41 | 7.8....10.0 |

FIG. 8

PRECOOLED VAPOR-LIQUID REFRIGERATION CYCLE

BACKGROUND OF THE INVENTION

This invention relates generally to closed refrigeration cycles using a compressor and throttle device and more particularly concerns a vapor liquid refrigeration system using two closed cycles wherein one cycle works independently or is supplemented by the second cycle.

Vapor-liquid refrigeration cycles (VLC) are widely used to provide refrigeration at temperatures in a range of 250K to 280K (approximately −10° F. to 45° F.).

FIG. 1(*a*) is a schematic of the physical elements in a VLC system. The associated thermodynamic processes are represented in the temperature-enthalpy T-h diagram of FIG. 1(*b*) and the temperature entropy T-s diagram of FIG. 1(*c*). In the known manner, a compressor discharges a high pressure, high temperature refrigerant in gaseous form to a condenser 12 which is cooled by flow of a media, for example, ambient air, or piped water, to remove heat of compression from the refrigerant.

The refrigerant, now a cooler gas, a condensed liquid, or a mixture of gas and liquid, flows to a throttle device 14, such as a control valve, capillary tube or an orifice, whereby the refrigerant pressure drops. In accordance with the Joule-Thomson effect, the refrigerant becomes colder as the pressure drops and the cooler refrigerant flows through an evaporator 16 before returning to the low pressure inlet of the compressor 10. Thus a repetitive cycle provides continuous refrigeration in the evaporator 16 where the load, which is to be cooled, is applied.

The letters a–g in the FIGS. 1*b–c* represent corresponding points in the refrigerant circuit of FIG. 1*a*a. The cooling effect for a unit weight flow of refrigerant at the evaporator 16 is represented in the T-h diagram between the points c and d as a change in enthalpy. If the condenser 12 is cooled with air at ambient temperature Ta, and the ratio of ambient temperature to refrigeration temperature Tr, the temperature of the load in the evaporator, does not exceed Ta/Tr=1.15 . . . 1.2, then the VLC is an efficient cycle in providing refrigeration.

As examples, an actual refrigeration cycle using ammonia as a refrigerant and operating with an ambient air temperature of 293K and a refrigeration temperature of 255K, had a coefficient of performance of 3.67. A similar refrigeration cycle operating with refrigerant-12 (R-12) between an ambient temperature of 295K and a refrigeration temperature of 258K had a coefficient of performance of 4.05.

Coefficient of performance is a standard that equals refrigeration capacity-Qr divided by compressor power consumption-Pc. In other words, with R-12, the cooling effect in watts, for example, is approximately four times greater than the power consumption in watts. (A fan to move condenser air was not considered in this exemplary calculation.)

However, increasing the temperature ratio Ta/Tr, that is, when the ambient air temperature rises, reduces the values of coefficient of performance. The cycle is thermodynamically less efficient and consumes more power for each amount of cooling that is produced.

Alternatively to the VLC, other refrigeration cycles have been developed to reduce the deleterious effect of higher ambient temperature at the condenser 12.

In FIG. 2(*a*), the regenerative refrigeration cycle RVLC is mechanically similar to that of FIG. 1(*a*), however, with the addition of a heat exchanger 18. Similar components have similar reference numerals in the different constructions.

Refrigerant leaving the condenser 12 flows through a high pressure path 20 of the heat exchanger 18 before entering the throttle device 14. The low pressure refrigerant leaving the evaporator 16 passes through the low pressure path 22 before entering the return side of the compressor 10. The paths 20, 22 are in counterflow heat transfer relationship with each other. Thereby, the refrigerant leaving the condenser is further cooled prior to entering the throttle device 14; this additional cooling is effected by the colder refrigerant leaving the evaporator 16.

Removal of heat from the refrigerant flowing between the points a and c of the FIGS. 2*a–c* is represented in FIG. 2*b* by the line ab. As a result of this heat exchange process, the amount of refrigeration effect, change in enthalpy, available for cooling between the points c–d on the diagrams is increased, as is readily apparent in comparing FIGS. 1*b* and 2*b*.

In addition to improving the refrigeration capacity per unit weight flow of refrigerant, the regenerative cycle RVLC of FIG. 2*a* provides an improved coefficient of performance and especially an improvement of cycle efficiency when ratio Ta/Tr is in a range above 1.15–1.2.

Another alternative cycle in the prior art to improve on the coefficient of performance of a VLC is illustrated in FIG. 3*a*, namely, a cascade vapor refrigeration cycle CVLC.

The cascade system includes two subsystems that are physically similar to the vapor liquid refrigeration cycle of FIG. 1*a*. Accordingly, similar reference numerals are again used as in FIGS. 1*a*, 2*a*, with addition of the prime sign on the reference numerals in the second cycle of FIG. 3*a*.

In the cascade system, the evaporator 16' associated with the compressor 10', is used to cool the condenser 12 of the other cycle associated with the compressor 10. Because the load on the secondary evaporator 16' is at a much higher temperature than the load on the evaporator 16, the supplemental cycle including the compressor 10' can operate throughout at higher corresponding temperature levels and still provide the required temperature differential to make heat transfer between the condenser 12 and the evaporator 16' effective and efficient. The condenser 12' of the auxiliary cycle is cooled by the ambient air at temperature Ta. The thermodynamic cycles are illustrated in FIG. 3*b*; the higher temperature auxiliary cycle is marked with prime designations.

Although the overall ratio of temperatures Ta/Tr may be substantially similar between the embodiment of FIG. 3*a* and the embodiment of FIG. 1*a*, the intermediate temperature ratios between the condenser and the evaporator in each closed cycle of FIG. 3*a* is much less than for the overall system. Stated otherwise, each of the cycles operates at a low temperature ratio that enables a higher refrigeration capacity from each cycle, a higher coefficient of performance from each cycle, and improved performance for the cascaded arrangement of FIG. 3*a* as compared to the arrangement of FIG. 1*a*.

It is also known that the two compressors of FIG. 3*a* can be replaced with a single 2-stage compression cycle (not shown), which would have thermodynamic characteristics and performance characteristics which are closely similar to the cascade cycle of FIGS. 3*a, b*.

Descriptions of the performances of the cycles of FIGS. 1*a–*3*a* were somewhat idealized for the sake of discussion. Practical applications present real problems not immediately apparent from the information presented above.

In many actual situations, it is necessary to provide effective refrigeration when the ambient air temperature varies over wide limits. For example, air conditioning systems and many systems in food refrigeration and industrial refrigeration, have to operate under conditions where the ambient may change in a range from 280K to 320K (approx. 45° F. to 120° F.) during the year. For a vapor liquid refrigeration cycle (FIG. 1*a*) both the coolant capacity Qr and the coefficient of performance decrease with increasing ambient temperature when air is used in cooling the condenser.

For example, in a vapor liquid refrigeration cycle VLC the coefficient of performance changes from 5.33 to 2.22 and the cooling capacity Qr, expressed in watts, varies from 332 watts to 234 watts as the ambient air used for cooling the condenser changes in temperature from 285K to 323K.

A comparison of the other refrigeration cycles (FIGS. 2*a*, 3*a*) with the vapor liquid refrigeration cycle (FIG. 1*a*) at an ambient temperature of 323K is presented in Table 1 of FIG. 8. This comparison proves a well-known correlation that the more complicated cycles, that is, RVLC and CVLC, have a better performance when compared to the simpler vapor liquid refrigeration cycle VLC. The regenerative cycle RVLC operated with a pressure ratio, compressor discharge to compressor inlet of 15/1.5, similar to that of the simpler vapor liquid refrigeration VLC.

Despite the similar pressure ratios, the regenerative cycle RVLC provides greater values of refrigeration capacity and coefficient of performance. However, the RVLC is not useful for an application at higher ambient temperatures, because the compressor discharge temperature becomes extremely high. This temperature corresponds to point 7 in the cycles of FIGS. 1*a*, 2*a*, 3*a*. When the temperature at point a in the RVLC is greater than 380K, compressor oil may start to decompose. This high temperature also results in a reduction in coefficient of performance under actual conditions because actual compressor efficiency becomes worse at high ambient temperatures.

The cascade cycle CVLC (FIGS. 3*a*, *b*) has better characteristics compared to the VLC and the RVLC at high ambient temperatures. But in this cycle, two compressors must always run simultaneously at any ambient temperature. At low ambient temperatures, a single compressor cycle VLC would be efficient in handling the load. The advantage of this performance characteristic is lost in the CVLC because both compressors must be operative. In actual practice it turns out that the two compressors CVLC cannot provide better efficiency when compared to a single compressor cycle VLC because the power efficiency of the actual compressors decreases when the pressure ratios, mentioned above, become very small.

Table 1 illustrates that the pressure ratio is much less in the cascade unit compared to the VLC or RVLC. This is an advantage if the ratio of the ambient temperature to refrigeration temperature Ta/Tr is high. But it is a disadvantage if the ratio Ta/Tr is small. Thus the cascade system does not provide, and is not able to provide, high power efficiency in situations where the ambient temperature can be expected to vary in a wide range.

In summary, comparison of the vapor-liquid cycles shows that with regard to both overall refrigeration capacity Qr and coefficient of performance, the values of these parameters decreased at high ambient temperatures. None of the cycles can be efficient overall if the ambient temperature varies in a broad range.

What is needed is a refrigeration cycle of improved overall refrigeration capacity and improved coefficient of performance (COP), when the system operates with ambient temperatures which vary over a broad range.

SUMMARY OF THE INVENTION

Accordingly, it is an object of the invention to provide a refrigeration cycle that has improved overall refrigeration capacity and improved coefficient of performance for operation over a wide range of ambient temperatures.

Another object of the invention is to provide an improved refrigeration cycle that has performance characteristics of a basic VLC cycle when ambient conditions are favorable for VLC operation.

Yet another object of the invention is to provide an improved refrigeration cycle that has better performance than a basic VLC cycle when ambient conditions are unfavorable for VLC operation.

A further object of the invention is to provide an improved refrigeration cycle that includes two refrigeration cycles, a basic cycle and an auxiliary cycle, the basic cycle being usable independently of said auxiliary cycle when ambient conditions are favorable.

A precooled vapor-liquid refrigeration cycle in accordance with the invention includes a basic vapor-liquid cycle and an auxiliary regenerative vapor-liquid cycle having a heat exchange relationship between them.

The basic cycle includes a compressor connected in series with a condenser, throttle device, and evaporator. The auxiliary cycle includes a compressor, condenser, throttle device, and a counterflow heat exchanger, successively connected. The cycles each have condensers that are cooled by ambient air at temperature Ta. Thus, the basic cycle is able to operate independently of the auxiliary cycle.

In order to maximize coefficient of performance, the basic cycle operates without a large pressure differential between the high pressure discharge of its compressor and the low pressure return to the compressor. At best, the condenser cools the refrigerant flowing between the compressor and the evaporator to a temperature equal to the ambient air temperature Ta that cools the condenser. In the heat exchanger the refrigerant flow from the basic cycle condenser is further cooled in a counterflow arrangement by low temperature refrigerant from the auxiliary cycle until the refrigerant in the basic cycle has been precooled from near ambient temperature Ta to near the intended refrigeration temperature Tr. Thereby, the efficiency of the basic cycle is improved, as is the overall COP of the system.

At the same time, the refrigerant leaving the condenser in the auxiliary cycle, after passing through the auxiliary throttle device, flows through the heat exchanger in counterflow arrangement with the very same refrigerant stream. In this way, the capacity of the auxiliary cycle to remove heat is enhanced, just as in the basic cycle.

Simply stated, with the heat exchanger, in each cycle a given mass flow of refrigerant has a capability to provide a greater cooling effect. Thereby the coefficient of performance of each cycle is improved, as is the coefficient of performance of the entire combination.

The basic vapor-liquid cycle may operate using a single refrigerant, a zeotropic (non azeotropic) or an azeotropic mixture. To increase energy efficiency, the auxiliary regenerative vapor-liquid cycle operates with a zeotropic refrigerant.

Other objects, features and advantages of the invention will in part be obvious and will in part be apparent from the specification.

This invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 8 is a table of performances using different cycles of the prior art and the present invention.

DETAILED DESCRIPTION OF PREFERRED EMBODIMENTS

Figure 4A:
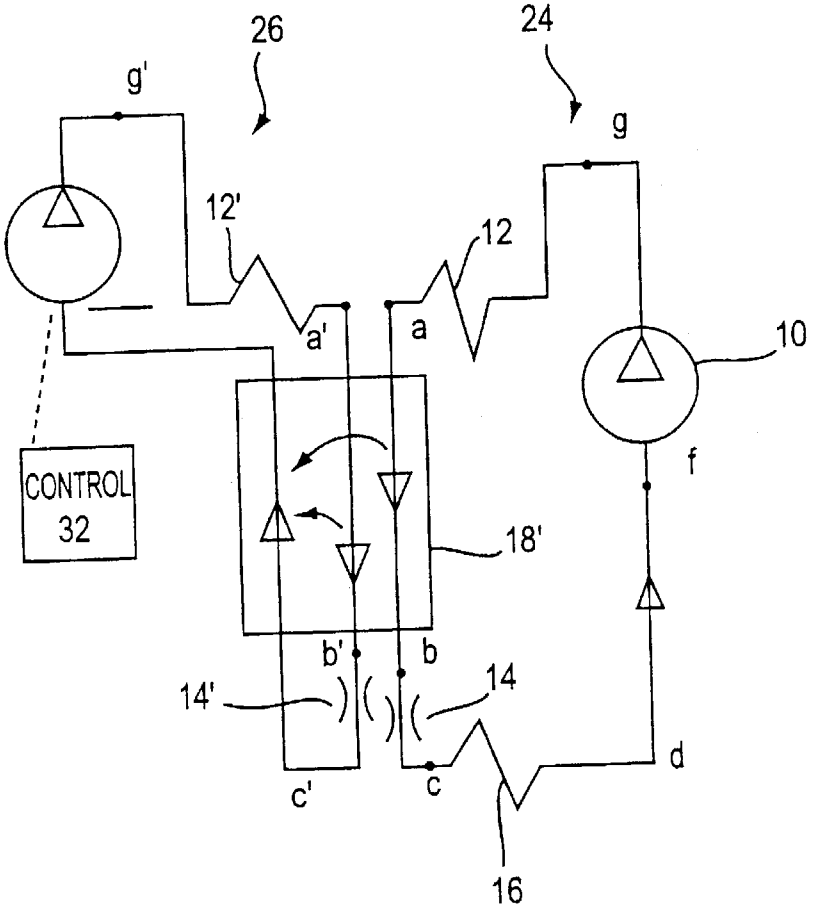
FIG. 4*a* is a schematic diagram of a pre-cooled vapor liquid refrigeration cycle PVLC in accordance with the invention.

A precooled vapor-liquid refrigeration cycle in accordance with the invention includes (FIG. 4*a*) a basic vapor-liquid cycle 24 and an auxiliary regenerative vapor-liquid cycle 26, having a heat exchange relationship between the cycles as explained hereinafter. The structure of the basic cycle 24 is similar to that shown in FIG. 1*a* and similar reference numerals are used to indicate similar elements.

Figure 3A:
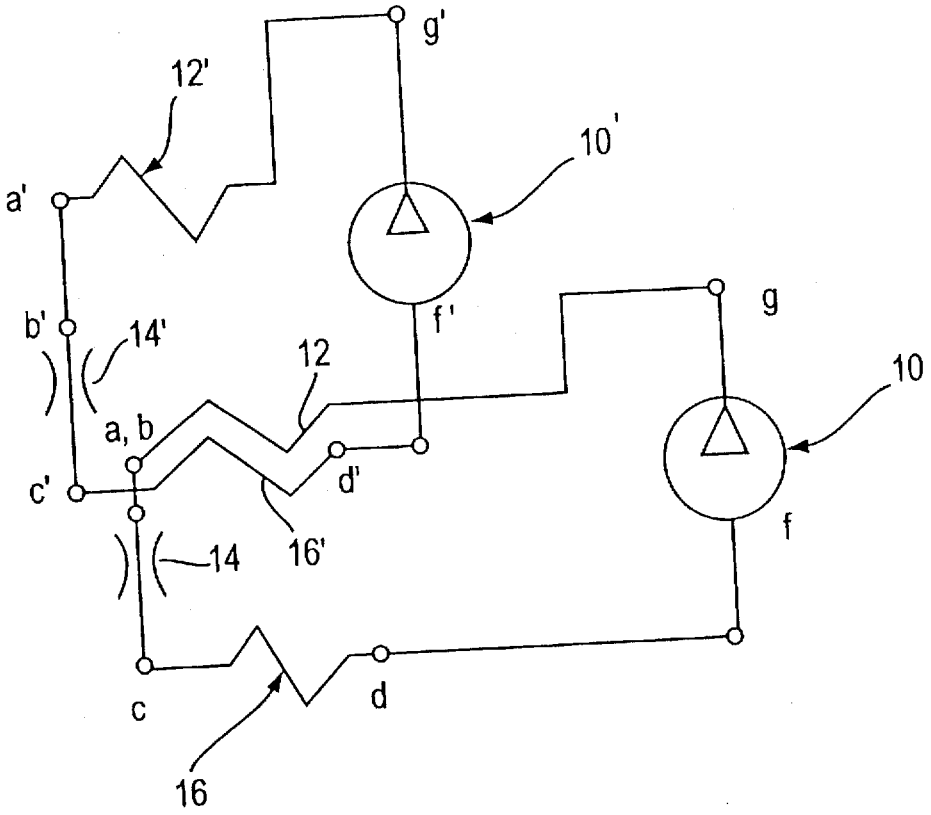
FIG. 3*a* is a cascade vapor liquid refrigeration cycle CLVC of the prior art.
Figure 3B:
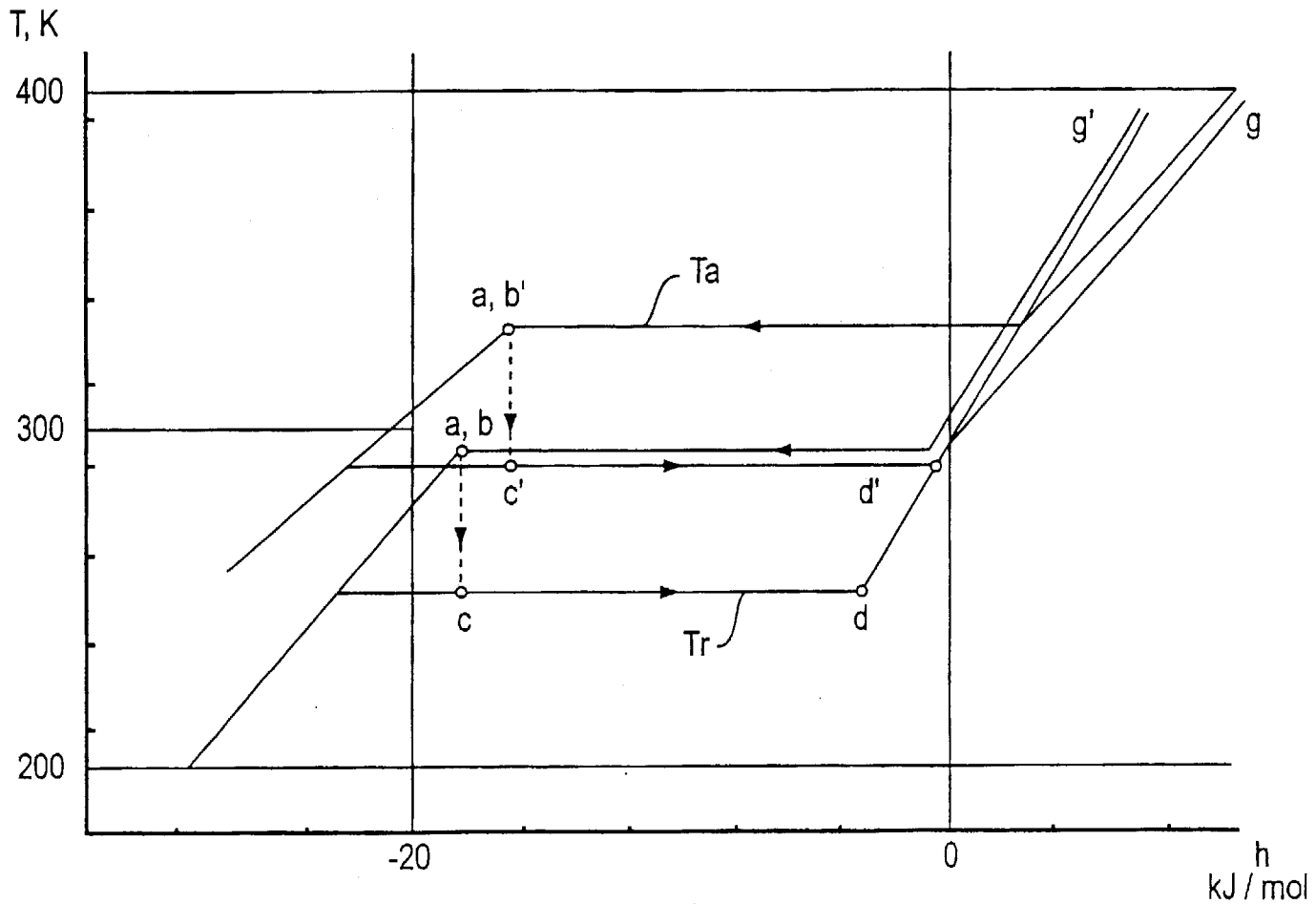
FIG. 3*b* shows the thermodynamic diagrams of the cycle of FIG. 3*a;*

The basic cycle 24 includes a compressor 10 connected in series with a condenser 12, throttle device 14, and evaporator 16. The auxiliary cycle 26 includes a compressor 10', condenser 12', and a counterflow heat exchanger 18', successively connected. Unlike the cascade cycle of FIG. 3*a*, the cycles 24, 26 each have condensers 12, 12' that are cooled by ambient air at temperature Ta. Thus, the basic cycle 24 is able to operate independently of the cycle 26.

In order to maximize coefficient of performance, it is necessary that the basic cycle 24 operate without a large pressure differential between the high pressure discharge of the compressor 10 and the low pressure return to the compressor. At best, the condenser 12 can cool the refrigerant flowing from the compressor 10 toward the evaporator 16 to a temperature equal to the ambient air temperature Ta that cools the condenser 12 (This corresponds to the performance in FIGS. 1*a, b*). In the heat exchanger 18', the refrigerant flow from the condenser 12 is further cooled by low temperature refrigerant from the auxiliary cycle 26 in a counterflow arrangement until the refrigerant has been precooled from near the ambient temperature Ta to near the intended refrigeration temperature Tr.

Figure 2C:
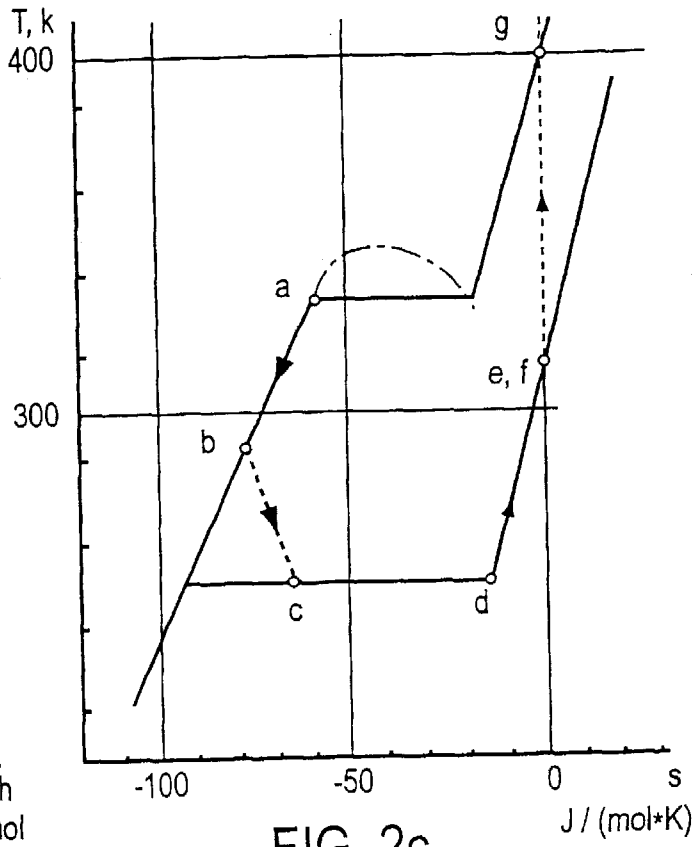
FIGS. 2*b* and 2*c* show thermodynamic diagrams of the cycle of FIG. 2*a;*
Figure 2B:
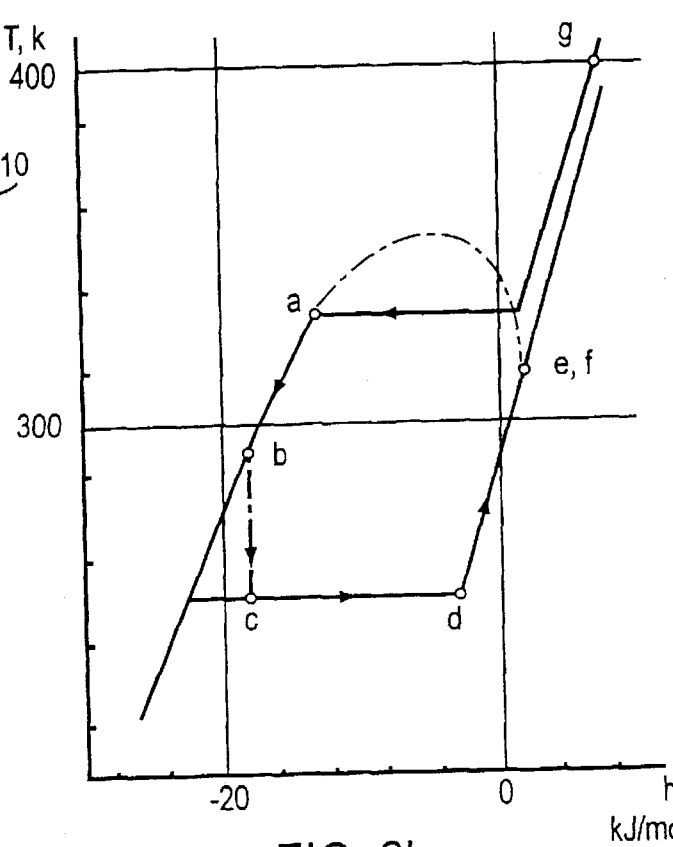
Figure 2A:
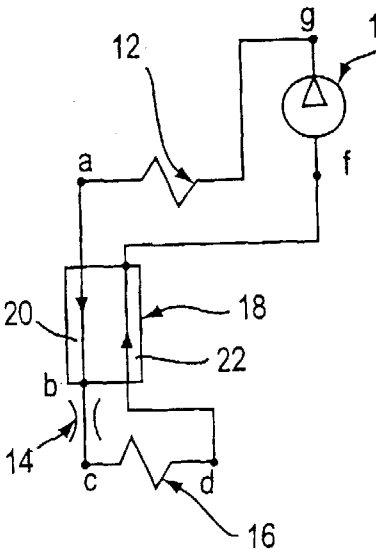
FIG. 2*a* is a regenerative vapor liquid refrigeration cycle RVLC of the prior art.
Figures 4B, 4C:
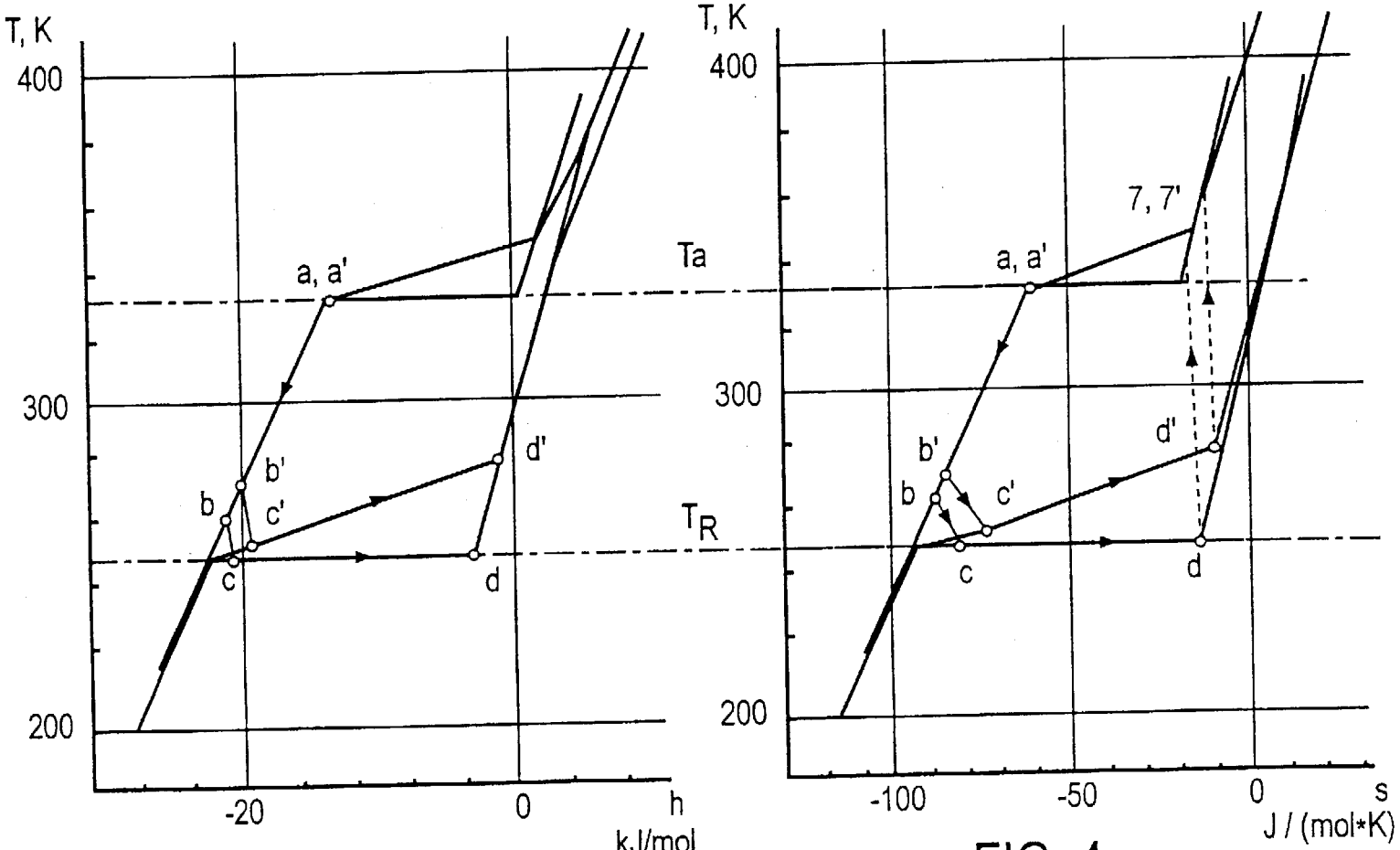
FIGS. 4*b* and 4*c* are diagrams showing thermodynamic processes of the cycle of FIG. 4*a;*

Thus, as in FIGS. 2*b, c*, the refrigerant in the basic cycle 24 is cooled from the point a to the point b (FIGS. 4*b, c*) before entering the throttle device 14. Thereby, the efficiency of the cycle 24 is improved, as is the overall COP of the system.

At the same time, the refrigerant leaving the condenser 12' in the auxiliary cycle 26, flows through the heat exchanger 18' in counterflow arrangement with the very same refrigerant after the refrigerant has passed through the throttle device 14'. In this way, the capacity of the auxiliary cycle 26 to remove heat is enhanced just as in the basic cycle 24. That is, the refrigerant flowing from the condenser 12' to the throttle device 14' is cooled from point a' to point b', which provides an increased cooling capability (d' minus c') as compared to the cooling capability that would exist if the refrigerant from the condenser 12' went directly to the expansion device 14'.

Simply stated, with the heat exchanger 18', for each cycle 24, 26, a given mass flow of refrigerant has a capability to provide a greater cooling effect. Thereby the coefficient of performance of each cycle is improved as is the coefficient of performance of the entire combination.

The basic vapor-liquid cycle 24 operates using a single refrigerant, for example, R12, NH3, or an azeotropic mixture, for example R502. The auxiliary regenerative vapor-liquid cycle 26 operates with a non-azeotropic mixture refrigerant, for example, R22/R142b/R123, providing refrigeration distributed in the temperature range between Tr and Ta.

There may be different schematics of the interaction of the two cycles 24, 26 to provide high pressure flow precooling by means of a mixed refrigerant cycle 26. As stated, the basic cycle 24 is able to cool its evaporator 16 and reject heat to the ambient environment whether or not the auxiliary cycle 26 is operative.

Figure 5:
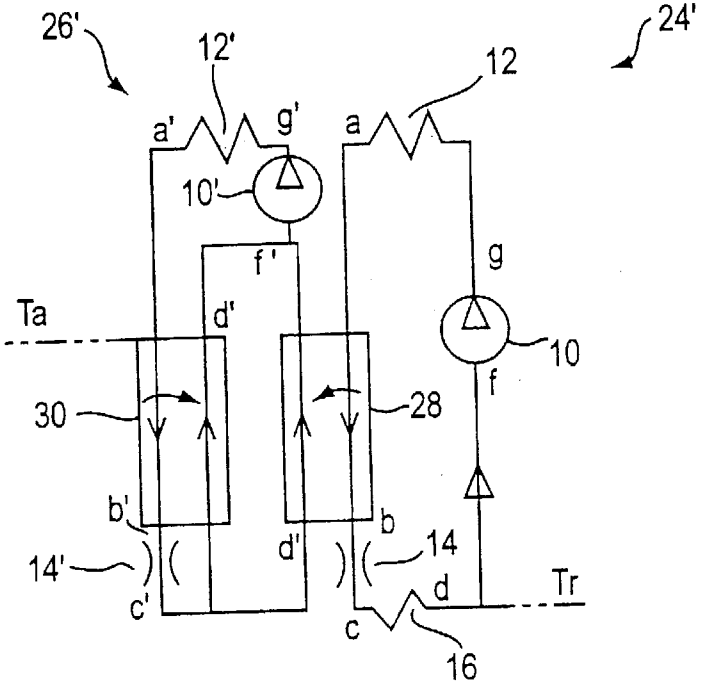
FIG. 5 is an alternative embodiment of a pre-cooled vapor liquid refrigeration cycle in accordance with the invention.

In an alternative arrangement in accordance with the invention (FIG. 5), the heat exchanger 18' is replaced with a pair of counterflow heat exchangers 28, 30. These heat exchangers 28, 30 provide the same functions as the heat exchanger 18' of FIG. 4*a*. Namely, in the auxiliary cycle 26', refrigerant from the condenser 12' passes through the throttle device 14', whereby its pressure drops to provide a low temperature, low pressure refrigerant. This refrigerant flows through the heat exchanger 28 to cool the refrigerant leaving the condenser 12 near ambient temperature and prior to entering the throttle device 14. Thus, the thermodynamic cycle is improved by precooling of the incoming refrigerant to the throttle device 14 as described above.

A portion of the cold low-pressure refrigerant passing through the throttle device 14' is used in the heat exchanger 30 to cool the incoming refrigerant from the condenser 12' near ambient temperature Ta and approaching the throttle device 14'. Thus, the thermodynamic efficiency of the auxiliary cycle 26' is also improved. The thermodynamic diagrams of FIGS. 4*b, c* also apply to the construction of FIG. 5.

It will be appreciated by those skilled in the art that the heat transfer functions that have been described herein as counterflow may also be effected in parallel flow, cross flow and mixed flow heat exchangers.

The auxiliary cycle 26' stabilizes the refrigerant temperature at the inlet to the throttle device 14 within a narrow range regardless of wide variations in the ambient temperature of the air that is used to cool the condensers 12, 12'. Thus, it is possible without special adjustments, to maintain high efficiency for each cycle, and a high coefficient of performance for each cycle, as well as the entire system.

The precooled vapor-liquid cycle refrigeration system in accordance with the invention (FIGS. 4*a*, 5) may operate in two different modes.

Figure 1C:
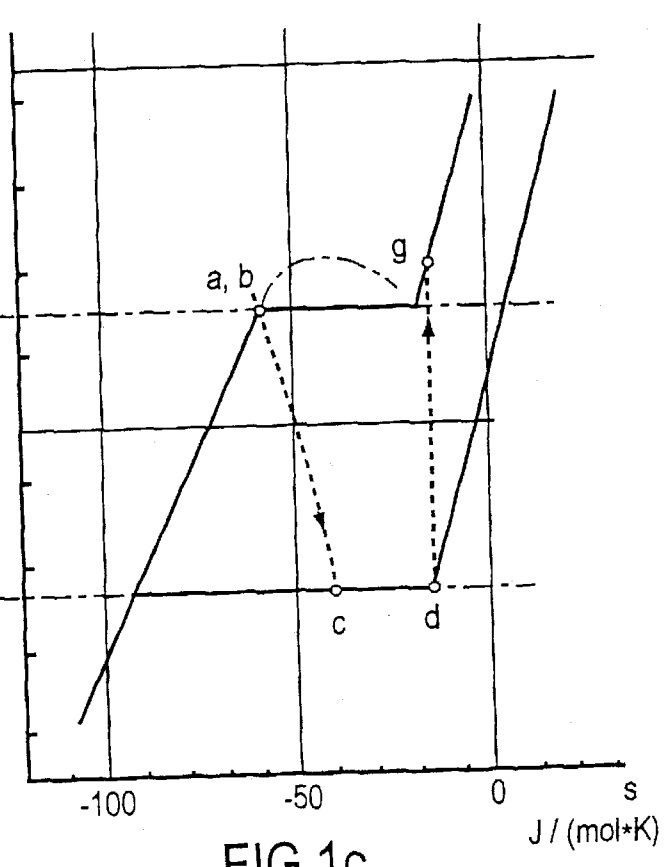
FIGS. 1*b* and 1*c* are thermodynamic diagrams of the cycle of FIG. 1*a;*
Figure 1B:
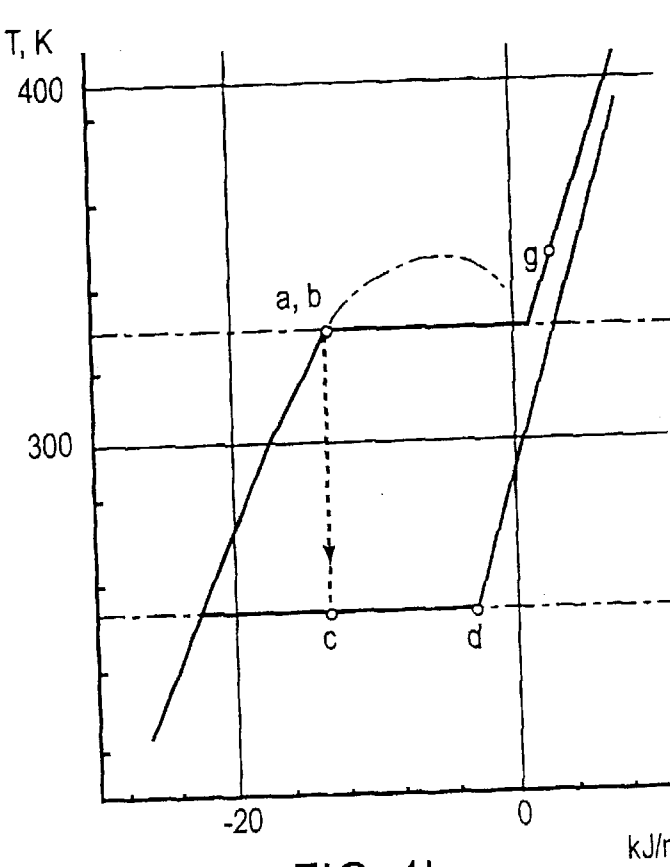
Figure 1A:
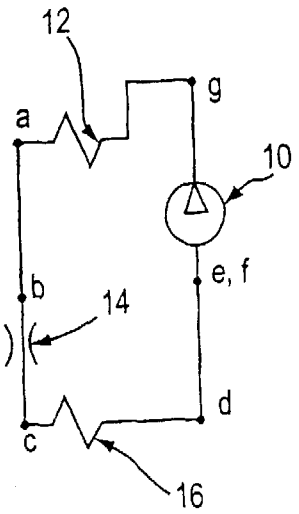
FIG. 1*a* is a schematic diagram of a vapor liquid refrigeration cycle VLC of the prior art.

When the ambient temperature Ta is relatively low, then the basic cycle 24 will operate efficiently on its own and the auxiliary cycle compressor 10' may be switched off by a control unit 32. Then the performance of the system will be the same as for the prior art vapor-liquid cycle VLC operating with a single compressor (FIG. 1*a*).

When the ambient temperature is above a pre-determined lower ambient temperature Ta' as sensed by the control unit 32, both cycles 24, 26 are run concurrently to improve the refrigeration capacity Qr and COP value of the basic cycle 24 while the auxiliary cycle 26 operates with high efficiency.

The power efficiency of the proposed precooled vapor-liquid cycle refrigeration system in accordance with the invention depends on the mixed refrigerant composition as well as the influence of the auxiliary cycle on the performance parameters of the entire system. When the precooling temperature, that is the temperature of the refrigerant entering the throttle device 14 of the basic cycle 24, is maintained essentially the same as the refrigeration temperature in the evaporator 16 of the basic cycle, it has been found that the cooling capacity Qr is maximized, and stays substantially constant regardless of the value of the ambient temperature Ta.

It is a unique feature of the precooled vapor-liquid compression refrigeration system in accordance with the invention that performance is maintained substantially independently of the value of Ta because all of the cycles of the prior art have decreasing refrigeration capacity Qr when the ambient temperature becomes higher.

The COP values of the precooled cycle of the invention depend on the type of the auxiliary compressor, the mixed refrigerant composition, and the manner of cycle regulation. The mixed refrigerant in the auxiliary cycle should comprise at least two components, one of which has a normal boiling temperature essentially the same or lower than the basic cycle refrigerant, and another component that has a higher normal boiling temperature than the basic cycle refrigerant. The mixed refrigerant provides a compressor suction pressure in the auxiliary cycle which is higher than the suction pressure in the basic cycle. A mixed refrigerant used with good results in the auxiliary cycle included 40%±10% R22, 30%±10% R142b, and 30%±10% R123 (mol fractions).

Figure 6:
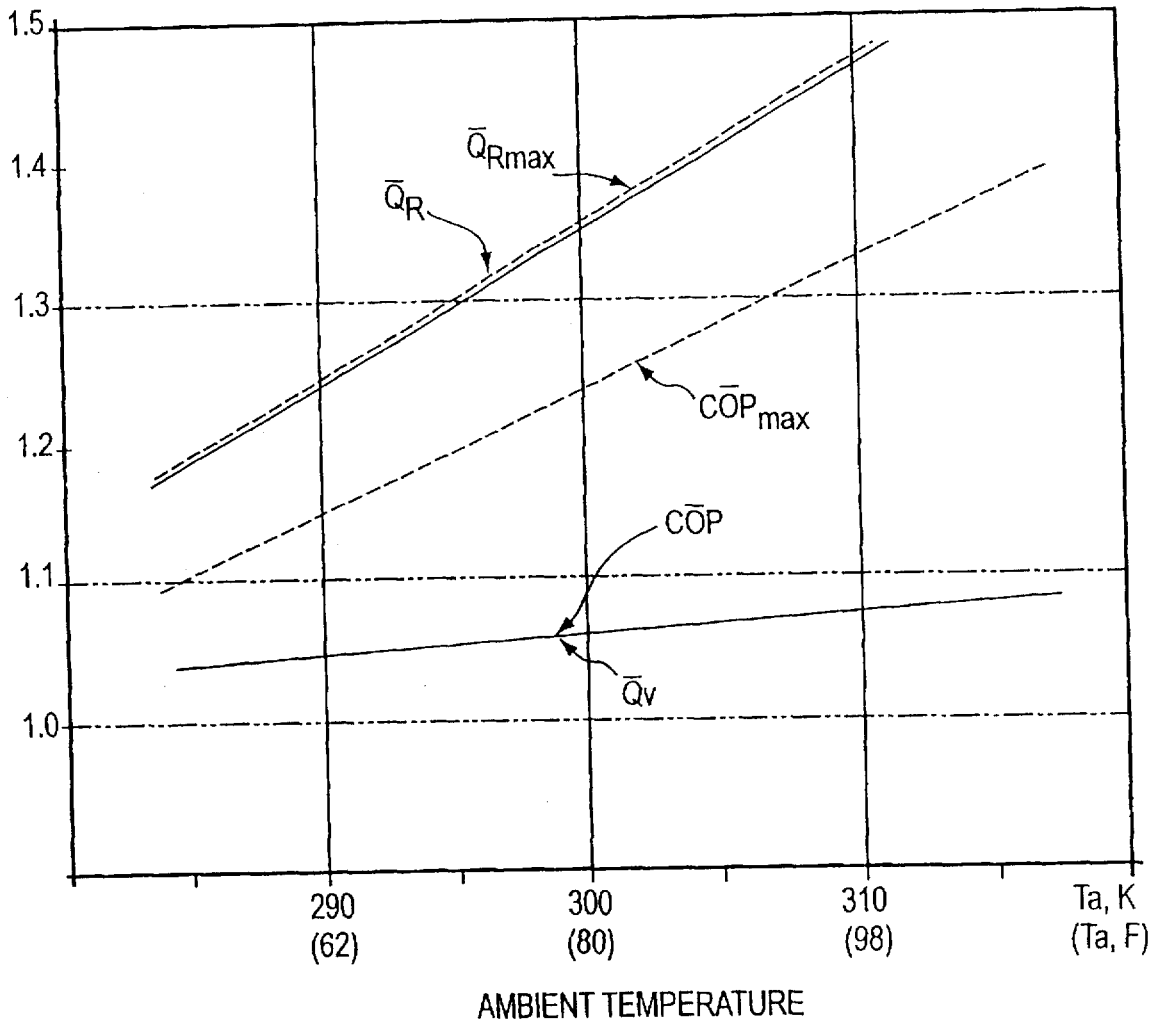
FIG. 6 is a graph of calculated PVLC performance characteristics for a basic cycle relative to VLC (using R-12)
Figure 7:
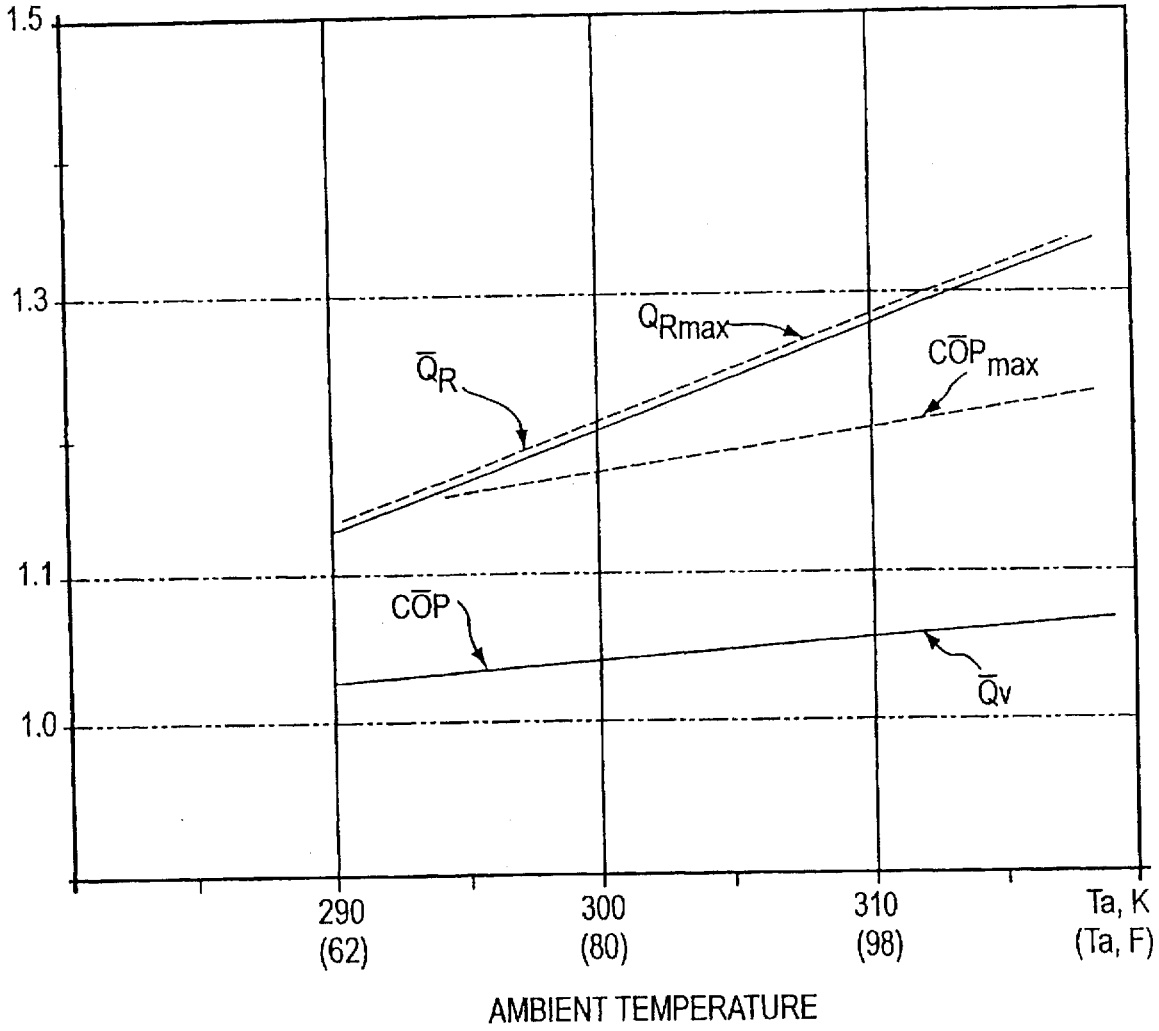
FIG. 7 is a graph similar to FIG. 6 using ammonia as refrigerant in the basic cycle.

FIGS. 6 and 7 represent calculated results for refrigerant R12 and ammonia, respectively used in the basic cycle 24. These figures indicate both the maximum limit of coefficient of performance improvement that may be expected from the present invention based upon the selected refrigerant, compressor, etc. Also illustrated are the minimal limits of COP improvement that may be expected. These calculated improvements are with respect to the basic vapor-liquid cycle refrigeration system of FIG. 1*a*. In preparing these figures, it was assumed that the auxiliary mixed refrigerant cycle was designed for operation at the minimal anticipated operating ambient temperature, and the cycle then operated over the entire ambient temperature range without any regulation.

When the ambient temperature was changed, the auxiliary cycle parameters changed according to the mixed refrigerant properties. Even with the simplifying assumption of no regulation, the proposed precooled vapor-liquid cycle refrigeration system in accordance with the invention provides better coefficients of performance values, and provides power consumption savings not less than 5–10% compared to the basic vapor-liquid cycle operating alone. The calculated savings depended upon the assumed ambient temperatures. The lines of "maximum" characteristics assume that there is optimized construction and performance at each ambient temperature. (See also FIG. 8 for comparison with prior art cycles).

In summary, maintenance of stable conditions at the inlet and outlet of the throttle device when other parameters in the system are changing, will generally aid in maintaining efficient performance for the basic cycle and for an overall system in spite of the changes in other operating conditions. The conditions at the inlet and outlet of the throttle device are selected to provide nominal performance with a high level of performance efficiency. An auxiliary system is brought into use to maintain conditions at the throttle device when external factors would otherwise cause changes at the throttle device. The principles are applicable in systems that do not rely on ambient air but use another medium for condenser coolant. It is not necessary that both cycles use the same type of condenser coolant. Having the basic cycle capable of efficient operation independently of any auxiliary means is a valuable feature, providing a highest operating efficiency when operating conditions are favorable for VLC.

Accordingly, it can be seen that the objects set forth above and those made apparent from the preceding description are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A refrigeration system for operation in a wide range of ambient temperatures, and for connection to an evaporator, comprising:

a basic refrigeration cycle for circulating a first refrigerant, said basic cycle including, connected in series, a first compressor, a first condenser using ambient air as a coolant, and a first throttle device for delivering said first refrigerant at low pressure to an evaporator that absorbs heat from a load;

an auxiliary refrigeration cycle for circulating a second refrigerant, said second refrigerant being a zeotropic refrigerant, said auxiliary cycle including a second compressor, a second condenser using ambient air as a coolant, and a second throttle device; and heat exchanger means for cooling an outflow of said first refrigerant that flows from said first condenser in said basic cycle towards said first throttle device, heat transferred from said basic cycle by said heat exchanger means being delivered to said auxiliary cycle for rejection to ambient by said second condenser, a temperature at an inlet to said first throttle device being stabilized by said heat exchanger means during changes in ambient temperature, wherein said second refrigerant includes at least two components, one of said at least two components having a normal boiling temperature which is close to the boiling temperature of said basic first refrigerant, another component of said at least two components having a higher normal boiling temperature than said first refrigerant of said basic cycle, and wherein said heat exchanger means includes a first high pressure path connected between a refrigerant outlet of said first condenser and said inlet to said first throttle device, and a first low pressure path between an outlet of said second throttle device and an inlet to said second compressor, said first high pressure path and said first low pressure path having a heat transfer relationship therebetween.

2. A refrigeration system as in claim 1, wherein said second refrigerant is a mixture 40%±10% R22, 30%±10% R142b and 30%±10% R 123, by mol fractions.

3. A refrigeration system as in claim 1, wherein said first refrigerant is one of a single substance and an azeotropic mixture.

4. A refrigeration system as in claim 1, wherein said second refrigerant is selected to operate in said auxiliary cycle with a temperature at an outlet of said second throttle device that approximately equals an operating refrigeration temperature of said basic cycle.

5. A refrigeration system as in claim 3, wherein said second refrigerant is selected to operate in said auxiliary cycle with a temperature at an outlet of said second throttle device that approximately equals an operating refrigeration temperature of said basic cycle.

6. A refrigeration system as in claim 1, wherein said first refrigerant is one of a single substance, a zeotropic, and an azeotropic mixture.

7. A refrigeration system as in claim 1, wherein said second refrigerant is selected to operate in said auxiliary cycle with a temperature at an outlet of said second throttle device that approximately equals an operating refrigeration temperature of said basic cycle.

8. A refrigeration system as in claim 1, further comprising control means for selectively making said auxiliary cycle either operative or inoperative, said control means being responsive to ambient temperature, said auxiliary cycle being made operative at a first ambient temperature and inoperative at a second ambient temperature, said first ambient temperature being higher than said second ambient temperature.

9. A refrigeration system as in claim 1, wherein said second refrigerant produces a compressor suction pressure in said auxiliary cycle which is greater than a suction pressure of said first compressor in said basic cycle.

10. A refrigeration system as in claim 1, wherein said second refrigerant in said auxiliary cycle is a zeotropic mixed refrigerant.

11. A refrigeration system as in claim 1, wherein said first refrigerant is one of R-12, R-22, R502, NH3, and their susbstitutes.

12. A refrigeration system as in claim 1, further comprising an evaporator connected in series between said first throttle device and an inlet to said first compressor.

13. A refrigeration system for operation in a wide range of ambient temperatures, and for connection to an evaporator, comprising:

a basic refrigeration cycle for circulating a first refrigerant, said basic cycle including, connected in series, a first compressor, a first condenser using ambient air as a coolant, and a first throttle device for delivering said first refrigerant at low pressure to an evaporator that absorbs heat from a load;

an auxiliary refrigeration cycle for circulating a second refrigerant, said auxiliary cycle including a second compressor, a second condenser using ambient air as a coolant, and a second throttle device;

heat exchanger means for cooling an outflow of said first refrigerant that flows from said first condenser in said basic cycle towards said first throttle device, heat transferred from said basic cycle by said heat exchanger means being delivered to said auxiliary cycle for rejection to ambient by said second condenser, a temperature at an inlet to said first throttle device being stabilized by said heat exchanger means during changes in ambient temperature, said heat exchanger means including a first high pressure path connected between a refrigerant outlet of said first condenser and said inlet to said first throttle device, and a first low pressure path between an outlet of said second throttle device and an inlet to said second compressor, said first high pressure path and said first low pressure path having a heat transfer relationship therebetween, and a second high pressure path connected between a refrigerant outlet of said second condenser and an inlet to said second throttle device, said second high pressure path being in heat transfer relationship with said first low pressure path between said outlet of said second throttle device and said inlet to said second compressor.

14. A refrigeration system for operation in a wide range of ambient temperatures, and for connection to an evaporator, comprising:

a basic refrigeration cycle for circulating a first refrigerant, said basic cycle including, connected in series, a first compressor, a first condenser using ambient air as a coolant, and a first throttle device for delivering said first refrigerant at low pressure to an evaporator that absorbs heat from a load;

an auxiliary refrigeration cycle for circulating a second refrigerant, said auxiliary cycle including a second compressor, a second condenser using ambient air as a coolant, and a second throttle device; and heat exchanger means for cooling an outflow of said first refrigerant that flows from said first condenser in said basic cycle towards said first throttle device, heat transferred from said basic cycle by said heat exchanger means being delivered to said auxiliary cycle for rejection to ambient by said second condenser, a temperature at an inlet to said first throttle device being stabilized by said heat exchanger means during changes in ambient temperature, said heat exchanger means including a first high pressure path connected between a refrigerant outlet of said first condenser and said inlet to said first throttle device, and a first low pressure path between an outlet of said second throttle device and an inlet to said second compressor, said first high pressure path and said first low pressure path having a heat transfer relationship therebetween, and a second low pressure path in parallel with said first low pressure path and a second high pressure path connected between a refrigerant outlet of said second condenser and an inlet to said second throttle device, said second low pressure path being in heat transfer relationship with said second high pressure path.

15. A refrigeration system for connection to an evaporator, comprising:

a basic refrigeration cycle for circulating a first refrigerant, said basic cycle including, connected in series, a first compressor, a first condenser using at least one of gas and liquid as a coolant, and a first throttle device for delivering said first refrigerant at low pressure to an evaporator that absorbs heat from a load;

an auxiliary refrigeration cycle for circulating a second refrigerant, said auxiliary cycle including a second compressor, a second condenser using at least one of gas and liquid as a coolant, and a second throttle device;

heat exchanger means for cooling an outflow of said first refrigerant that flows from said first condenser in said basic cycle towards said first throttle device, heat transferred from said basic cycle by said heat exchanger means being delivered to said auxiliary cycle for rejection by said second condenser, a temperature at an inlet to said first throttle device being stabilized by said heat exchanger means, said heat exchanger means having a first high pressure path including a refrigerant outlet of said first condenser and said inlet to said first throttle device, and a first low pressure path including an outlet of said second throttle device and an inlet to said second compressor, said first high pressure path and said first low pressure path having a heat transfer relationship therebetween, and a second high pressure path connected between a refrigerant outlet of said second condenser and an inlet to said second throttle device, said second high pressure path being in heat transfer relationship with said first low pressure path between said outlet of said second throttle device and said inlet to said second compressor.

16. A refrigeration system as in claim 15, wherein said first refrigerant is one of a single substance and an azeotropic mixture.

17. A refrigeration system as in claim 16, wherein said single substance is a zeotropic.

18. A refrigeration system as in claim 15, wherein said second refrigerant is selected to operate in said auxiliary cycle with a temperature at an outlet of said second throttle device that approximately equals an operating refrigeration temperature of said basic cycle.

19. A refrigeration system as in claim 16, wherein said second refrigerant is selected to operate in said auxiliary cycle with a temperature at an outlet of said second throttle device that approximately equals an operating refrigeration temperature of said basic cycle.

20. A refrigeration system as in claim 15, wherein said second refrigerant produces a compressor suction pressure in said auxiliary cycle which is greater than a suction pressure of said first compressor in said basic cycle.

21. A refrigeration system as in claim 15, wherein said second refrigerant in said auxiliary cycle is a zeotropic mixed refrigerant.

22. A refrigeration system as in claim 15, further comprising an evaporator connected in series between said first throttle device and an inlet to said first compressor.

23. A refrigeration system for connection to an evaporator, comprising:

a basic refrigeration cycle for circulating a first refrigerant, said basic cycle including, connected in series, a first compressor, a first condenser using at least one of gas and liquid as a coolant, and a first throttle device for delivering said first refrigerant at low pressure to an evaporator that absorbs heat from a load;

an auxiliary refrigeration cycle for circulating a second refrigerant, said auxiliary cycle including a second compressor, a second condenser using at least one of gas and liquid as a coolant, and a second throttle device; and heat exchanger means for cooling an outflow of said first refrigerant that flows from said first condenser in said basic cycle towards said first throttle device, heat transferred from said basic cycle by said heat exchanger means being delivered to said auxiliary cycle for rejection by said second condenser, a temperature at an inlet to said first throttle device being stabilized by said heat exchanger means, said heat exchanger means having a first high pressure path including a refrigerant outlet of said first condenser and said inlet to said first throttle device, and a first low pressure path including an outlet of said second throttle device and an inlet to said second compressor, said first high pressure path and said first low pressure path having a heat transfer relationship therebetween, and a second low pressure path in parallel with said first low pressure path and a second high pressure path connected between a refrigerant outlet of said second condenser and an inlet to said second throttle device, said second low pressure path being in heat transfer relationship with said second high pressure path.

24. A refrigeration system as in claim 23, wherein said first refrigerant is one of a single substance and an azeotropic mixture.

25. A refrigeration system as in claim 24, wherein said second refrigerant is selected to operate in said auxiliary cycle with a temperature at an outlet of said second throttle device that approximately equals an operating refrigeration temperature of said basic cycle.

26. A refrigeration system as in claim 24, wherein said single substance is a zeotropic.

27. A refrigeration system as in claim 23, wherein said second refrigerant is selected to operate in said auxiliary cycle with a temperature at an outlet of said second throttle device that approximately equals an operating refrigeration temperature of said basic cycle.

28. A refrigeration system as in claim 23, wherein said second refrigerant produces a compressor suction pressure in said auxiliary cycle which is greater than a suction pressure of said first compressor in said basic cycle.

29. A refrigeration system as in claim 23, wherein said second refrigerant in said auxiliary cycle is a zeotropic mixed refrigerant.

30. A refrigeration system as in claim 23, further comprising an evaporator connected in series between said first throttle device and an inlet to said first compressor.

* * * * *